US006871929B2

(12) United States Patent
Crivelli et al.

(10) Patent No.: US 6,871,929 B2
(45) Date of Patent: Mar. 29, 2005

(54) SYSTEM AND METHOD FOR OPTIMIZING TEMPERATURE OPERATING RANGES FOR A THERMAL INKJET PRINTHEAD

(75) Inventors: Paul M. Crivelli, San Diego, CA (US); Maria Dinares, Terrassa (ES); Rosa Maria Gomez, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/834,093

(22) Filed: Apr. 12, 2001

(65) Prior Publication Data

US 2002/0149639 A1 Oct. 17, 2002

(51) Int. Cl.[7] ..... B41J 29/38
(52) U.S. Cl. ..... 347/17
(58) Field of Search ..... 347/14, 17, 19

(56) References Cited

U.S. PATENT DOCUMENTS 4,403,229 A * 9/1983 Barteck ..... 347/92
4,791,435 A * 12/1988 Smith et al. ..... 347/17
5,175,565 A * 12/1992 Ishinaga et al. ..... 347/14
5,629,578 A * 5/1997 Winzer et al. ..... 310/334
6,059,394 A * 5/2000 Moriyama ..... 347/14
6,135,656 A * 10/2000 Kato et al. ..... 347/14
6,219,153 B1 * 4/2001 Kawanabe et al. ..... 347/14

* cited by examiner

*Primary Examiner*—Stephen D. Meier
*Assistant Examiner*—Julian D. Huffman

(57) ABSTRACT

The present invention is embodied in a system and method for optimizing the temperature operating range for a thermal inkjet printhead using pigmented ink over large print swaths. The printhead assembly includes connection and processing circuitry, a printhead body, ink channels, a substrate, such as a semiconductor wafer (commonly referred to as a die), a nozzle member and a barrier layer located between the wafer and nozzle member. The nozzle member has heating elements in arrays, as well as plural nozzles coupled to respective ink channels and is secured at a predefined location to the printhead body with a suitable adhesive layer. The printhead also includes a controller, which can be an integrated circuit processor, a printer driver, firmware or the like for controlling an increase in the mean temperature of the die through a feedback loop. The loop activates the heating elements and therefore increases the baseline temperature of the die before printing, and in turn decreases the temperature differential between the baseline temperature and the mean temperature of the die.

22 Claims, 3 Drawing Sheets

SYSTEM AND METHOD FOR OPTIMIZING TEMPERATURE OPERATING RANGES FOR A THERMAL INKJET PRINTHEAD

FIELD OF THE INVENTION

The present invention generally relates to inkjet printers and in particular to a system and method for optimizing the temperature operating range of inkjet printers using pigmented ink over large print swaths with high throughput.

BACKGROUND OF THE INVENTION

Inkjet printers are commonplace in the computer field. These printers are described by W. J. Lloyd and H. T. Taub in "Ink Jet Devices," Chapter 13 of *Output Hardcopy Devices* (Ed. R. C. Durbeck and S. Sherr, San Diego: Academic Press, 1988) and U.S. Pat. Nos. 4,490,728 and 4,313,684. Inkjet printers produce high quality print, are compact and portable, and print quickly and quietly because only ink strikes a printing medium, such as paper.

An inkjet printer produces a printed image by printing a pattern of individual dots at particular locations of an array defined for the printing medium. The locations are conveniently visualized as being small dots in a rectilinear array. The locations are sometimes "dot locations", "dot positions", or pixels". Pixels vary in size, the smaller the dot in the rectilinear array, means that more dots can be printed per inch of the printed medium. Smaller dots result in a more accurate rendition of the image and this in turn results in greater definition of the image. Thus, the printing operation can be viewed as the filling of a pattern of dot locations with dots of ink of specific size or from a combination of different sized dots.

Inkjet printers print dots by ejecting very small drops of ink onto the print medium and typically include a movable carriage that supports one or more print cartridges each having a printhead with a nozzle member having ink ejecting nozzles. The carriage traverses over the surface of the print medium. The width of the carriage varies among the different printers. For any line of print, the carriage may make more than one traverse and utilize a varying number of nozzles. An ink supply, such as an ink reservoir, supplies ink to the nozzles. The nozzles are controlled to eject drops of ink at appropriate times pursuant to command of a microcomputer or other controller. The timing of the application of the ink drops is intended to correspond to the pattern of pixels of the image being printed and to the physical properties of the ink and the print media.

In general, the ink is housed in a vaporization chamber with a tube leading to a nozzle exposed to the print media. Small drops of ink are ejected from the nozzles through orifices by rapidly heating a small volume of ink located in the vaporization chambers with small electric heaters, such as small thin film resistors. The small thin film resistors are usually located adjacent the vaporization chambers. Heating the ink causes the ink to vaporize and eject ink in the connecting tubing through the nozzle orifices. Specifically, for one dot of ink, an electrical current from an external power supply is passed through a selected thin film resistor of a selected vaporization chamber. The resistor is then heated and in turn heats a thin layer of ink located within the selected vaporization chamber, causing explosive vaporization, and, consequently, a droplet of ink is ejected from the nozzle and onto a print media. The vacuum created as the ink droplet is ejected from the nozzle acts as a suction pump to draw more ink into the vaporization chamber.

Gas is also held in solution in liquids such as ink. The colder the ink, the greater the amount of gas that is held. As the ink increases in temperature, the solubility of the gas decreases, and it leaves the solution in the form of bubbles. The higher the temperature, the more bubbles are formed, and they form at a faster rate. If the temperature reaches a sufficiently high temperature the solution itself may reach its boiling point and also form a gas. The bubbles from either source choke the nozzles and cause deterioration in the quality of the image on the print media.

Temperature also controls the uniformity of the drop size of the ejected ink. The heat from the resistors causing the explosive vaporization in the chamber also causes the size of the drop of ink formed in the chamber to vary. There is an optimal temperature operating range for printheads using inks, in particular, pigmented inks. If the temperature is too low the ink droplets formed will be smaller and have a lower drop-weight than that required for good image quality. As the temperature rises, the drop-weight of the ink droplet will rise. The variation in drop weight varies with the ink being used. These variations in drop-weight will cause visible hue shifts in the printed image.

The temperature will be high if the resistors fire a number of times in a short period of time. Also, if the length of the current pulse to the resistor is longer than a pre-determined limit. As the carriage traverses in a print swath, various heater elements in the array are activated. If the traverse is narrow, the mean temperature at the beginning of the traverse will be similar to the mean temperature at the conclusion, and the effect of temperature on the pass will be consistent for all ink droplets projected onto the print media. If the swath is wide, and more heater elements are activated, the mean temperature at the end of the pass may be considerably higher than at the beginning. The difference in temperature from the beginning of the pass to the end of the pass could result in variation in the drop-weight of ink droplets on the same pass. This would result in hue variation on the one line of print.

Generally, the temperature of the printhead is approximated by two measurements, the thermal sense resistor [TSR], and the digital temperature sensor [DTS]. The DTS is a point sensor located at the top of the die near a firing heating element. While this sensor more accurately reflects the temperature at that point, it does not give an accurate temperature for other heating elements on the die.

The TSR is an approximation of the mean temperature of the printhead die. It is not located adjacent to any particular heating element and reflects the temperature of the die after heat has moved from the heating elements to the TSR. There is, therefore, a delay in the temperature reported by the TSR. The longer the printhead fires, the greater will be the temperature recorded by the TSR. When the printhead has been idle, for example, at the beginning of a print pass, the temperature recorded by the TSR will be low as the die will be cool. The droplets produced at this time will be of low drop-weight. As the pass continues and the number of heating elements firing has increased, the temperature at the TSR will have increased and the drop-weight of the ink droplets will have increased. The difference in temperature from the beginning of the pass till the end of the pass will affect the size of the ink droplets across the pass.

To minimize the effect of temperature variance from the beginning of printing to another point in the printing process, a warming device may be employed. A warming device is used to raise the temperature of the printhead. The printhead assembly may include a means to control the electrical current to the firing resistors so that their temperature is below the threshold required to eject an ink drop. This device could be a power field effect transistor [FET]. The device provides a capability to warm the printhead assembly to the desired temperature before or during printing operations. The process is called "trickle warming" because the printhead assembly allows only a trickle of energy to flow to the firing resistors. The printhead assembly temperature rises until the desired temperature is reached and the warming device is then shut off. However, these systems do not effectively control increases in the mean temperature of the die, and hence, cannot optimize the temperature operating range of the die.

Therefore, what is needed is a method to control and decrease the temperature difference of the printhead from the beginning of the swath to the end, when necessary. What is also needed is a printing system that controls the temperature of the die by measuring and incorporating the temperatures of the heating elements in the printhead die and using these temperatures to preheat the die. What is additionally needed is a feedback loop to turn off these heating elements once an optimal operating temperature has been attained. What is further needed is a system that will produce a more uniform dot pattern on each print pass of the printhead, an improved quality of ink droplet size and a better image quality with a die temperature controller.

SUMMARY OF THE INVENTION

To overcome the limitations in the prior art described above, and to overcome other limitations that will become apparent upon reading and understanding the present specification, the present invention is embodied in a system and method for optimizing the temperature operating range for a thermal inkjet printhead using pigmented ink over large print swaths with high throughput.

The printhead assembly includes connection and processing circuitry, a printhead body, ink channels, a substrate, such as a semiconductor wafer (commonly referred to as a die), a nozzle member and a barrier layer located between the wafer and nozzle member. The nozzle member has heating elements in arrays, as well as plural nozzles coupled to respective ink channels and is secured at a predefined location to the printhead body with a suitable adhesive layer. The printhead also includes a controller, which can be an integrated circuit processor, a printer driver, firmware or the like for controlling an increase in the mean temperature of the die through a programmable feedback loop. The loop activates the heating elements and therefore increases the baseline temperature of the die before printing, and in turn decreases the temperature differential between the baseline temperature and the mean temperature of the die.

The controller can be defined in the integrated circuit as receiving the temperature of a digital temperature sensor (DTS) before printing begins, comparing this temperature with the set point for printing, initiating heating elements if the temperature is below the printing threshold, and turning off those heating elements when the threshold temperature of the die has been reached. The controller can be created by any suitable integrated circuit manufacturing or programming process.

The controller maintains the mean temperature of the die at a temperature that is within a predefined range of an optimal temperature for the production of a droplet of ink. There are pens for black inks and colored inks. Each pen will have a DTS feedback loop. Consequently, the present invention aids in controlling the temperature of specific sections of the die and the baseline temperature of the nozzle chambers associated with that section. This will result in improved conformity of the drop-weight of ink droplets as the printhead will operate at closer to the optimum temperature for the specific ink in the printing pass. This will result in a better quality image.

BRIEF DESCRIPTION OF THE DRAWINGS

The present invention can be further understood by reference to the following description and attached drawings that illustrate the preferred embodiment. Other features and advantages will be apparent from the following detailed description of the preferred embodiment, taken in conjunction with the accompanying drawings, which illustrate, by way of example, the principles of the invention.

DETAILED DESCRIPTION OF THE PREFERRED EMBODIMENTS

In the following description of the invention, reference is made to the accompanying drawings, which form a part hereof, and in which is shown by way of illustration a specific example in which the invention may be practiced. It is to be understood that other embodiments may be utilized and structural changes may be made without departing from the scope of the present invention.

Figure 1:
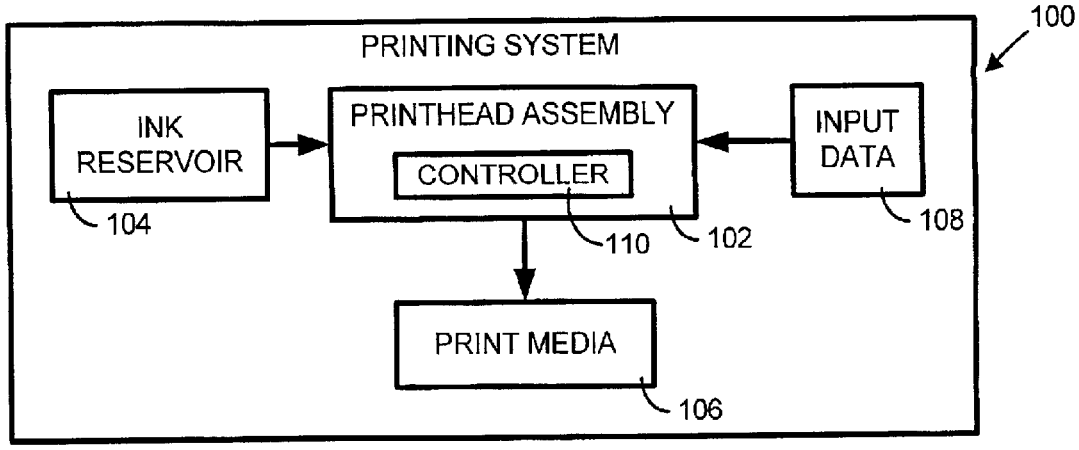
FIG. 1 shows a block diagram of an overall printing system incorporating the present invention.

I. General Overview:

FIG. 1 shows a block diagram of an overall printing system incorporating the present invention. The printing system 100 of the present invention includes a printhead assembly 102, ink supply 104 and print media 106. Input data to the printing system 100 comes from the input data channel 108. A temperature controller system 110 is included in the printhead assembly 102. The controller system 110 can be an integrated circuit, firmware, a software printer driver or the like and controls an increase in the mean temperature of the semiconductor wafer or die of the printhead through a feedback loop. The loop activates the heating elements and therefore increases the baseline temperature of the die before printing, and in turn decreases the temperature differential between the baseline temperature and the mean temperature of the die.

Figure 2:
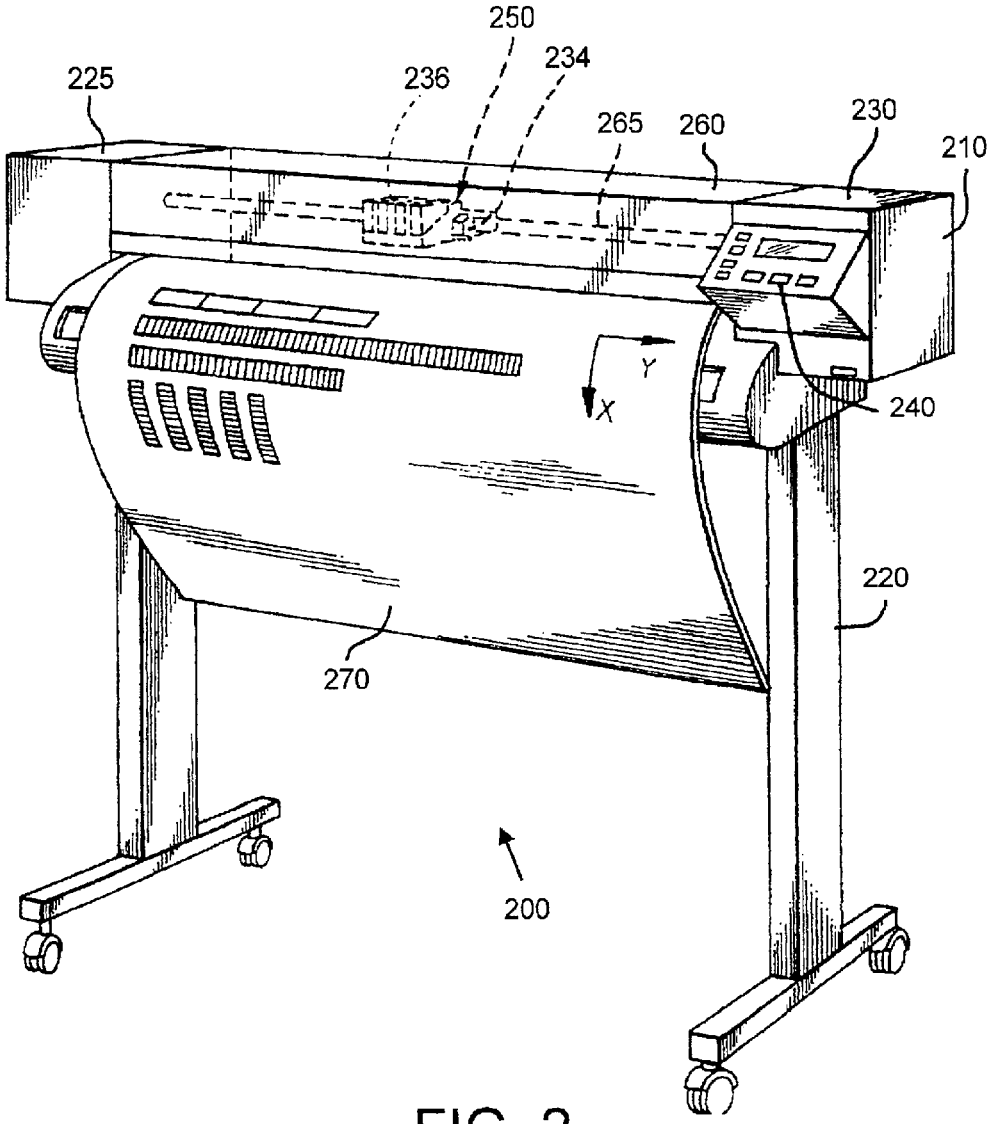
FIG. 2 is an exemplary printer that incorporates the invention and is shown for illustrative purposes only.

II. Exemplary Printing System:

FIG. 2 is a perspective view of an exemplary high-speed large format printing system 200 that incorporates the invention and is shown for illustrative purposes only. The printing system 200 includes a housing 210 mounted on a stand 220. The housing 210 has a left media transport mechanism cover 225 and a right media transport mechanism cover 230 housing a left media transport mechanism (not shown) and a right media transport mechanism (not shown), respectively. A control panel 240 is mounted on the right media transport mechanism cover 230 and provides a user interface with the printing system 200.

A printhead assembly 250 with print cartridges 236 is mounted on a carriage assembly 234, all being shown under a transparent cover 260. The carriage assembly 234 positions the printhead assembly 250 along a carriage bar 265 in a horizontal direction denoted by the "y" axis. A print media 270 (such as paper) is positioned by the media transport mechanism (not shown) in a vertical direction denoted by the "x" axis.

The present invention is equally applicable to alternative printing systems (not shown) such as those incorporating smaller format printers or grit wheel or drum technology to support and move the print media 106 relative to the printhead assembly 102. With a grit wheel design, a grit wheel and pinch roller move the media back and forth along one axis while a carriage carrying one or more printheads scans past the media along an orthogonal axis. With a drum printer design, the media is mounted to a rotating drum that is rotated along one axis while a carriage carrying one or more printheads scans past the media along an orthogonal axis. In either the drum or grit wheel designs, the scanning is typically not done in a back and forth manner as is the case for the system depicted in FIG. 2.

The print cartridges 236 may be removeably mounted or permanently mounted to the scanning carriage 234. Also, the print cartridges 236 can have self-contained ink reservoirs in the body of the printhead (shown in FIG. 3) as the ink supply 104 (shown in FIG. 1). The self-contained ink reservoirs can be refilled with ink for reusing the print cartridges 236. Alternatively, the print cartridges 236 can be each fluidically coupled, via a flexible conduit 240, to one of a plurality of fixed or removable ink containers 242 acting as the ink supply 104 (shown in FIG. 1). As a further alternative, ink supplies 104 can be one or more ink containers separate or separable from print cartridges 236 and removeably mountable to carriage 234.

Figure 3:
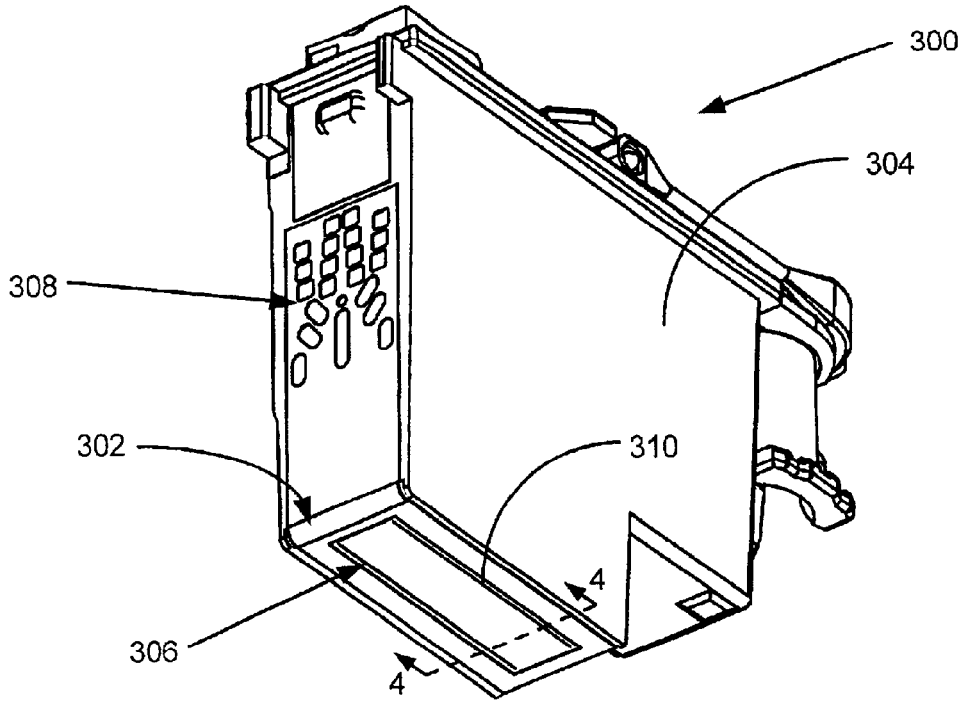
FIG. 3 shows for illustrative purposes only a perspective view of an exemplary print cartridge incorporating the present invention.

FIG. 3 shows for illustrative purposes only a perspective view of an exemplary printhead assembly 300 (an example of the printhead assembly 102 of FIG. 1) incorporating the present invention. A detailed description of the present invention follows with reference to a typical printhead assembly used with a typical printer, such as printer 200 of FIG. 2. However, the present invention can be incorporated in any printhead and printer configuration.

Referring to FIGS. 1 and 2 along with FIG. 3, the printhead assembly 300 is comprised of a thermal head assembly 302 and a printhead body 304. The thermal head assembly 302 can be a flexible material commonly referred to as a Tape Automated Bonding (TAB) assembly. The thermal head assembly 302 contains a flexible nozzle member 306 and interconnect contact pads (not shown) and is secured to the printhead assembly 300. The thermal head assembly 302 can be secured to the print cartridge 300 with suitable adhesives. An integrated circuit chip (not shown) provides feedback to the printer 200 regarding certain parameters of printhead assembly 300. The contact pads align with and electrically contact electrodes (not shown) on carriage 234. The nozzle member 306 preferably contains plural parallel rows of offset nozzles 310 through the thermal head assembly 306 created by, for example, laser ablation. It should be noted that other nozzle arrangements can be used, such as non-offset parallel rows of nozzles.

Figure 4:
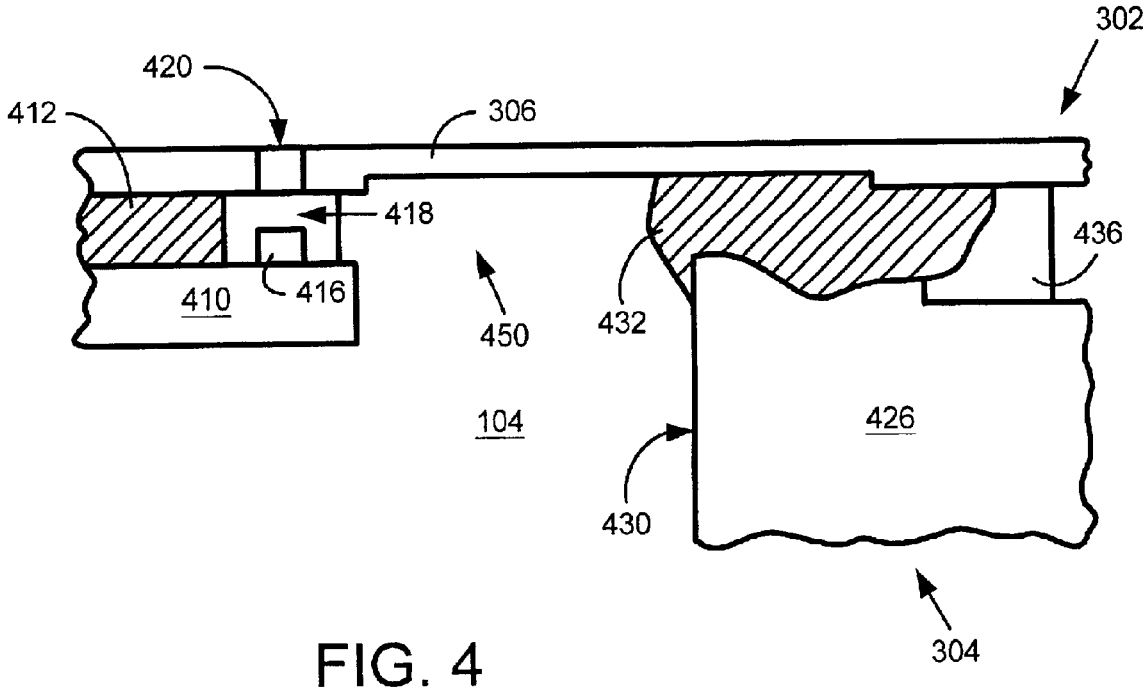
FIG. 4 is a schematic cross-sectional view taken through section line 4—4 of FIG. 3 showing the ink chamber arrangement of the print cartridge of FIGS. 1 and 3.

III. Component Details:

FIG. 4 is a cross-sectional schematic taken through section line 4—4 of FIG. 3 of the inkjet print cartridge 300 utilizing the present invention. A detailed description of the present invention follows with reference to a typical printhead used with print cartridge 300. However, the present invention can be incorporated in any printhead configuration. Also, the elements of FIG. 4 are not to scale and are exaggerated for simplification.

Referring to FIGS. 1–3 along with FIG. 4, as discussed above, conductors (not shown) are formed on the back of thermal head assembly 302 and terminate in contact pads for contacting electrodes on carriage 234. The other ends of the conductors are bonded to the printhead 302 via terminals or electrodes (not shown) of a substrate 410, such as a semiconductor material, commonly referred to as a die. The substrate or die 410 has ink ejection elements 416 formed thereon and electrically coupled to the conductors. The integrated circuit chip provides the ink ejection elements 416 with operational electrical signals. A barrier layer 412 is located between the nozzle member 306 and the substrate 410 for insulating conductive elements from the substrate 410.

An ink ejection or vaporization chamber 418 is adjacent to each ink ejection element 416, as shown in FIG. 4, so that each ink ejection element 416 is located generally behind a single orifice or nozzle 420 of the nozzle member 306. The nozzles 420 are shown in FIG. 4 to be located near an edge of the substrate 410 for illustrative purposes only. The nozzle 420 can be located in other areas of the nozzle member 306, such as centered between an edge of the substrate 410 and an interior side of the body 304.

Each ink ejection element 416 acts as an ohmic heater when selectively energized by one or more pulses applied sequentially or simultaneously to one or more of the contact pads via the integrated circuit. The ink ejection elements 416 may be heater resistors or piezoelectric elements and for the purposes of the current invention will be heater resistors. The orifices 420 may be of any size, number, and pattern, and the various figures are designed to simply and clearly show the features of the invention. The relative dimensions of the various features have been greatly adjusted for the sake of clarity.

The printhead body 304 is defined by a headland portion 426 located proximate to the back surface of the nozzle member 306 and includes an inner raised support 430. An adhesive layer 432 is located between the back surface of the nozzle member 306 and a top surface of the inner raised support 430 to securely affix the nozzle member 306 to the headland 426. The inner raised support 430 preferably includes an overflow slot 436 for receiving excess adhesive (i.e., adhesive overflow during fabrication of the printhead).

Referring to FIGS. 1–4, during a printing operation, ink stored in an ink reservoir 104 defined by the printhead body 304 generally flows around the edges of the substrate 410 and into the vaporization chamber 418. Energization signals are sent to the ink ejection element 416 and are produced from the electrical connection between the print cartridges 236 and the printer 200. Upon energization of the ink ejection element 416, a thin layer of adjacent ink is superheated.

The ideal temperature for ejecting a droplet is about 50 degrees Celsius, but the heating element can reach a temperature of 500 degrees Celsius in 3 microseconds. If the controller fires a number of times in a short period, or the pulse of the firing was lengthened, the heating element would reach a temperature above that required to produce the correct sized ink drop. The energized heater element causes explosive vaporization and, consequently, causes a droplet of ink to be ejected through the orifice or nozzle 420. The vaporization chamber 418 is then refilled by capillary action. This process enables selective deposition of ink on print media 106 to thereby generate text and images. As such, when the printhead assembly 300 is scanned across the print media during printing, variations in the size or physical nature of the ink droplet will affect the location and/or the action of the ejected ink on the print media and therefore affect the quality of printing.

A. Controller System

Figure 5:
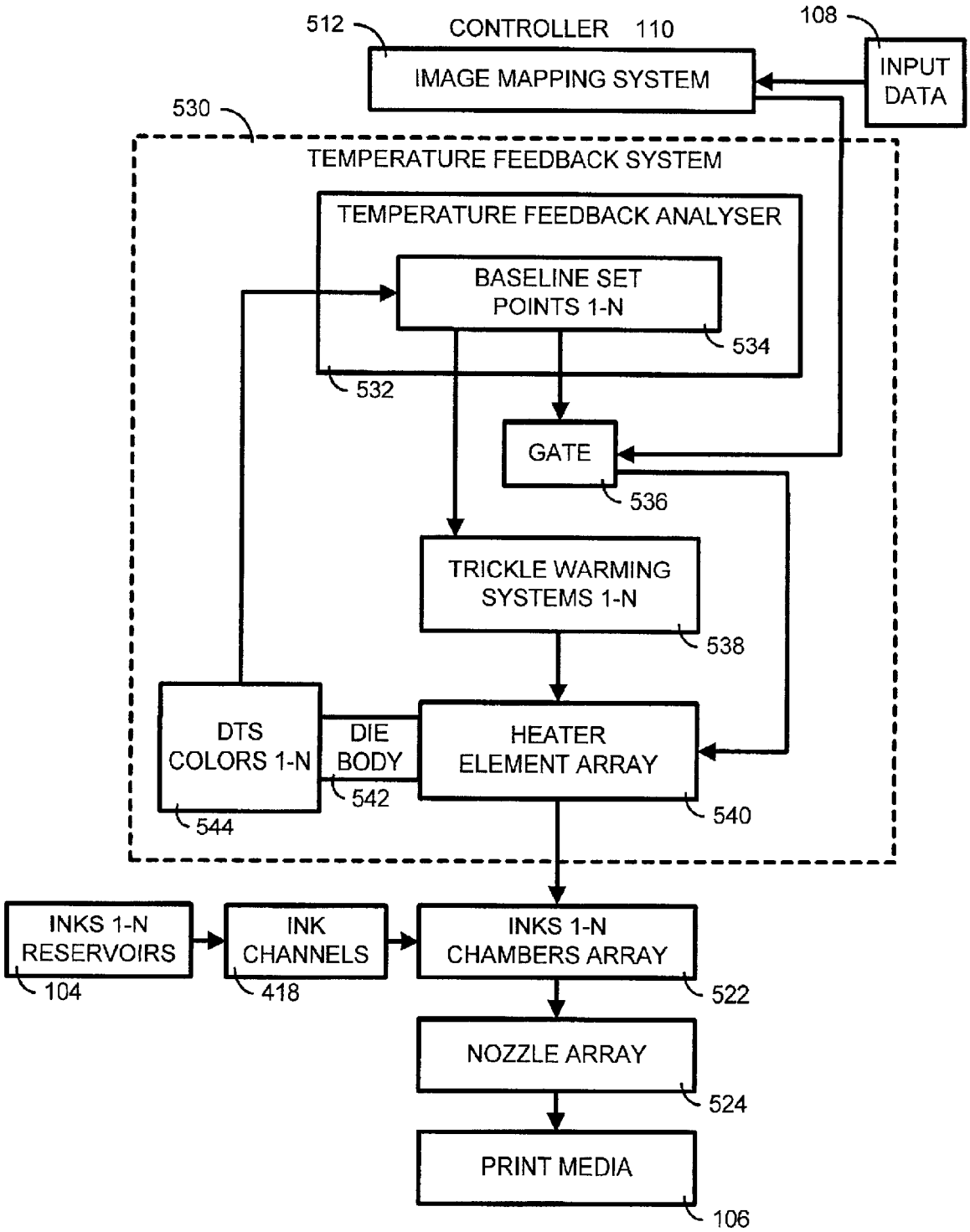
FIG. 5 shows a block diagram of the temperature sensor layout on the printhead incorporated in the present invention.

FIG. 5 is a block diagram illustrating the operation and integration of the printhead assembly 102 of FIG. 1. Referring to FIGS. 1–4 along with FIG. 5, during a printing operation, ink is provided from the ink supply to an interior portion, such as an ink reservoir 104 of the printhead body 304. The interior portion of the printhead body 304 provides ink to the ink channels 418 for allowing ejection of ink from the vaporization chambers through adjacent nozzles 420. Namely, the printhead assembly 102 receives commands from the controller 110 to print ink based on the input data 108 and form a desired pattern for generating text and images on the print media 106. Print quality of the desired pattern is dependent on accurate placement of the ink droplets on the print media 106.

One way to increase print quality using pigmented inks, is to improve the accuracy and precision of ink droplet formation. This can be achieved by producing droplets at an optimal temperature. In one embodiment, the ideal temperature for ejecting a droplet varies with the ink that is being heated. In this embodiment, the ideal temperature for black ink is 40 degrees centigrade, and 45 degrees centigrade for colored ink. Below these temperatures, the ink drop weight would be lower than that required for an ideal ink droplet. If the temperature rises over 50 degrees centigrade, the risk of nozzle choking through bubble formation becomes a real possibility. The heating element can reach a temperature of 500 degrees centigrade in 3 microseconds. Some control must therefore be exercised to keep temperatures within working limits.

To achieve this, in one embodiment of the present invention, the controller 110 includes a temperature feedback system 530 that defines the baseline operating temperature of the printhead. The temperature feedback system 530 is a controller that receives the temperature of 1 or 1–n digital temperature sensor[s] (DTS) 544. It calculates the temperature or temperatures of a particular die sector or sectors 542 and determines if it is at the threshold temperature for the ink[s] in that sector. If the temperature[s] is below the threshold baseline temperature, the temperature feedback system 530 inactivates the heater element array 540 by switching the gate 536.

When the printing system 100 is activated the trickle warming system 538 is turned on. This trickle warming system 538 remains activated throughout the printing process. A feature of this embodiment is that the various sectors of the die are kept at the optimal temperature, even if they are inactive during the print swath.

The trickle warming system 538 can use any suitable warming device and can include a controller for controlling the electrical current to the firing resistors so that their temperature is below the threshold required to eject an ink drop. This device could be a power field effect transistor [FET]. The FET device provides a capability to warm the printhead assembly to the desired temperature before or during printing operations. This system is referred to as trickle warming system because the printhead assembly 102 allows only a trickle of energy to flow to the firing resistors causing the temperature to rise to the set point.

When the temperature reaches the optimal set point a gate or switch 536 is opened so that the heater element array 540 can be activated. This system allows ink droplets being ejected from an associated ink chamber 522 to be at a preferred temperature for associated flowing ink. The ink droplets will more closely approximate ideal drop weight, so that the ink hue will be more consistent across the print swath. As the die 410 temperature before printing will be higher due to the trickle warming system, the difference between pre-swath temperatures and post swath temperatures will be reduced. This leads to more consistent hue across the print swath. In other words, the difference between the beginning temperatures reached through the trickle warming system 538 and end temperatures of the swath caused by the operation of the pen creates, more consistent hue across the print swath.

B. Temperature Feedback System

Referring to FIGS. 1–5, the input data 108 relates to the actual printed information on the print media 106. Locations of the printed output correspond to the input data 108. Each location represents a small dot in a rectilinear array. The locations vary in size and are related to the pixels of the image of the input data 108 that is to be printed on the print media 106. Smaller dots in the rectilinear array means that more dots can be printed per inch of the printed media and require a greater number elements in the heater element array 540 being fired.

The input data 108 is received by the image mapping system 512. The image mapping system 512 defines the pixel coordinates, the number and size of pixels to be produced, the colors of each pixel, and the color densities of each pixel. Information regarding pixels that require either black ink or the various colored inks is conveyed to the heater element array 540 through a temperature controlled gate 536. The elements of the heater element array 540 would be specific for the various colors to be printed which could include black and the various combinations of base colors in the cartridges in the printhead[s] 236. The colors that could be printed range from 1–n. The various inks required to produce colors may have differing baseline set points, 1–n, 534.

DTS region sensors[1–n] 544 sense the temperature of the heater elements on the heater element array 540 through the die body 542. The DTS region sensors, 1–n, 544 reflect the temperatures of the various heater elements, 1–n, 540 that heat the chambers in the ink chamber array [1–n] 522 for the various inks. The temperature feedback analyzer 532 monitors and observes temperatures of the DTS region sensors 544.

Information from the DTS sensors 544 is directed to the baseline set point [1–n] 534. The baseline set point 1–n 534 activates respective trickle warming systems 1–n 538 if any measured temperature is below the threshold determined for that particular ink. As the printer continues to print, the temperature feedback analyzer 532 continues to monitor the temperature through the DTS sensors 544 and adjusts the trickle warming system, 1–n, 538 accordingly, until the plot is finished. The trickle warming system 538 warms the die 542 to the threshold temperature, and at this point the DTS region sensor 544 forwards the temperature to the temperature feedback analyzer 532 which opens the gate 536. This in turn activates the respective elements in the heater element array 540.

The heater elements will heat and ink in the respective chamber array 522 will vaporize. Black ink droplets closer to optimal weights will be ejected from the black nozzles in the nozzle array 524 to the print media 106. Similarly, color droplets are produced on the print media 106 from the color nozzles in the nozzle array 524.

IV. Conclusion

In conclusion, with the system and method of the present invention, a dynamic and proactive printhead assembly is established through the temperature feedback system 530. This helps maintain the die at an optimum temperature for producing droplets in pigmented inks. The net effect of this invention is that a better quality of droplet will be produced. Consequently, the controller 110 maintains the printhead assembly 102 at a mean temperature that more closely approximates the optimal temperature for the formation of ink droplets. As such, activation of the trickle warming system [1–n] 538 is conducted in a more efficient and effective manner. The heater element array 540, and the nozzle array 524 create a pattern of ink droplets across a large swath. The reproduction of the image on the print media 106 based on the input data 108 would have less hue shifts across the swath.

The foregoing has described the principles, preferred embodiments and modes of operation of the present invention. However, the invention should not be construed as being limited to the particular embodiments discussed. The above-described embodiments should be regarded as illustrative rather than restrictive, and it should be appreciated that variations may be made in those embodiments by workers skilled in the art without departing from the scope of the present invention as defined by the following claims.

What is claimed is:

1. A printing system comprising:

a printhead comprising a substrate including a plurality of ink ejection elements that are arranged in N regions;

N region temperature sensors that each sense a temperature of one of the N regions; and a controller that adjusts a temperature of the substrate based upon an output of each of the N region temperature sensors and a pigment type of the ink that is to be ejected by the plurality of ink ejection elements.

2. The printing system of claim 1 further comprising a warming system that adjusts the temperature of the substrate in response to input from the controller.

3. The printing system of claim 2 wherein the warming system adjusts the temperature of the substrate by decreasing a temperature provided by the warming system.

4. The printing system of claim 2 wherein the warming system increases a temperature of the substrate prior to operation of the ink ejection elements.

5. The printing system of claim 4 wherein the controller allows operation of the plurality of ink ejection elements when the output of each of the N region temperature sensors is above a threshold.

6. The printing system of claim 5 wherein the threshold is a function of the pigment type of the ink that is to be ejected by the plurality of ink ejection elements.

7. The printing system of claim 6 wherein the threshold is 40 degrees Celsius for black pigmented ink and 45 degrees Celsius for color pigmented ink.

8. The printing system of claim 1 wherein the controller ceases operation of the ink ejection elements when the output of the N region temperature sensors is above a threshold.

9. The printing system of claim 1 wherein the controller maintains the temperature of the substrate within a predefined range from a starting point of a print swath to an ending point of the print swath.

10. A printing system comprising:

a printhead comprising a substrate including a plurality of ink ejection elements that are arranged in N regions;

means for sensing a temperature of each of the N regions; and means for adjusting a temperature of the substrate based upon an output of the means for sensing the temperature of each of the N regions and a pigment type of the ink that is to be ejected by the plurality of ink ejection elements.

11. The printing system of claim 10 further comprising means for Warming the temperature of the substrate in response to input from the means for adjusting.

12. The printing system of claim 11 wherein the means for warming adjusts the temperature of the substrate by decreasing the temperature provided by the means for warming.

13. The printing system of claim 11 wherein the means for warming increases the temperature of the substrate prior to operation of the ink ejection elements.

14. The printing system of claim 13 wherein the means for adjusting allows operation of the plurality of ink ejection elements when the output of the means for sensing is above a threshold.

15. The printing system of claim 14 wherein the threshold is a function of a pigment type of the ink that is to be ejected by the plurality of ink ejection elements.

16. The printing system of claim 15 wherein the threshold is 40 degrees Celsius for black pigmented ink and 45 degrees Celsius for color pigmented ink.

17. A printing system comprising:

a print cartridge comprising:

a printhead including a plurality of ink ejection elements that are arranged in N regions, and an ink supply including an ink having a pigment type, the ink being supplied for ejection by the ink ejection elements;

N region temperature sensors that each sense a temperature of one of the N regions; and a controller that adjusts a temperature of the substrate based upon an output of each of the N region temperature sensors and the pigment type of the ink.

18. The printing system of claim 17 wherein the controller adjusts the temperature of the substrate to a predetermined threshold based upon the pigment type prior to allowing ejection by the ink ejection elements.

19. The printing system of claim 18 wherein the controller allows operation of the plurality of ink ejection elements when the output of each of the N region temperature sensors is above a threshold.

20. The printing system of claim 19 wherein the threshold is 40 degrees Celsius for black pigmented ink and 45 degrees Celsius for color pigmented ink.

21. The printing system of claim 17 wherein the controller ceases operation of the ink ejection elements when the output of the N region temperature sensors is above a threshold.

22. The printing system of claim 17 wherein the controller maintains the temperature of the substrate within a predefined range from a starting point of a print swath to an ending point of the print swath.

* * * * *